United States Patent [19]

Goda

[11] Patent Number: 4,775,617

[45] Date of Patent: Oct. 4, 1988

[54] SILVER HALIDE COLOR PHOTOGRAPHIC MATERIAL CONTAINING MONODISPERSED TABULAR SILVER HALIDE GRAINS

[75] Inventor: Kensuke Goda, Kanagawa, Japan

[73] Assignee: Fuji Photo Film Co., Ltd., Kanagawa, Japan

[21] Appl. No.: 886,465

[22] Filed: Jul. 17, 1986

[30] Foreign Application Priority Data

Jul. 18, 1985 [JP] Japan ..... 60-158895

[51] Int. Cl.[4] ..... G03C 1/46; G03C 1/02

[52] U.S. Cl. ..... 430/567; 430/502; 430/503; 430/505; 430/569

[58] Field of Search ..... 430/567, 569, 505, 502, 430/503

[56] References Cited

U.S. PATENT DOCUMENTS

| | | | |
|---|---|---|---|
| 4,433,048 | 2/1984 | Solberg et al. | 430/567 |
| 4,434,226 | 2/1984 | Wilgus et al. | 430/567 |
| 4,439,520 | 3/1984 | Kofron et al. | 430/569 X |
| 4,444,865 | 4/1984 | Silverman et al. | 430/567 X |
| 4,461,826 | 7/1984 | Yamashita et al. | 430/567 X |
| 4,585,729 | 4/1986 | Sugimoto et al. | 430/502 |
| 4,609,621 | 8/1986 | Sugimoto et al. | 430/567 |

*Primary Examiner*—Mukund J. Shah

*Attorney, Agent, or Firm*—Sughrue, Mion, Zinn, Macpeak & Seas

[57] ABSTRACT

A silver halide color photographic material comprising a support having thereon at least one light-sensitive silver halide emulsion layer containing monodispersed silver halide grains wherein at least 50% of the total projected area of the monodispersed silver halide grains are tabular silver halide grains which have an aspect ratio of not less than 5.

The silver halide color photographic material has improved image sharpness, graininess and tone reproducibility.

16 Claims, No Drawings

SILVER HALIDE COLOR PHOTOGRAPHIC MATERIAL CONTAINING MONODISPERSED TABULAR SILVER HALIDE GRAINS

FIELD OF THE INVENTION

The present invention relates to a silver halide color photographic material having improved image sharpness and graininess.

BACKGROUND OF THE INVENTION

Image sharpness of photographic light-sensitive materials generally decreases with increasing thickness of an emulsion layer due to light scattering of the silver halide grains. In particular, in multilayer color photographic materials containing a red-sensitive emulsion layer, a green-sensitive emulsion layer and a blue-sensitive emulsion layer, the reduction in image sharpness of lower emulsion layers is remarkably large due to the cumulative effect of light scattering in the multilayer structure.

In U.S. Pat. No. 4,439,520, there is described a color photographic light-sensitive material having improved sharpness, sensitivity and graininess using tabular silver halide grains having a thickness of less than 0.3 micron, a diameter of at least 0.6 micron and a ratio of diameter/thickness, i.e., an aspect ratio of not less than 8 in at least one of the green-sensitive emulsion layer and the red-sensitive emulsion layer.

Such a method of utilizing tabular silver halide grains in a color photographic light-sensitive material is excellent since improvement in spectral sensitization efficiency, omission of yellow filter layer and improvement in sharpness can be realized.

However, tabular silver halide grains which are prepared by known methods have a broad grain size distribution and thus it is very difficult to expect a steep gradient (so-called "high gamma") of the characteristic curve. Further, the graininess in the low density region of negative images is inferior to that of emulsions consisting of non-tabular silver halide grains having a narrow grain size distribution.

The above-described defects are more conspicuous when such tabular grains are subjected to color reversal processing which basically comprises the sequential steps of black-and-white development (first development), reversal, color development, bleaching and fixing. More specifically, since tabular grains have a large ratio of surface area to volume, they are apt to be dissolved with a silver halide solvent contained in a first developing solution employed in the first development. In particular, when using tabular grains having a broad grain size distribution, grains having a smaller grain size are easily dissolved and disappear resulting in a decrease in image density after color development and in degradation of graininess due to a reduction in points for initiating color development, etc.

For the above reasons, it is very difficult to apply tabular silver halide grains to color photographic light-sensitive materials without an accompanying degradation of graininess.

SUMMARY OF THE INVENTION

Therefore, an object of the present invention is to provide a color photographic light-sensitive material having simultaneously improved sharpness, graininess and tone reproducibility.

Other objects of the present invention will be apparent from the following detailed description and examples.

The objects of the present invention are attained by a silver halide color photographic material comprising a support having thereon at least one light-sensitive silver halide emulsion layer containing monodisperse silver halide grains wherein at least 50% of the total projected area of the silver halide grains is provided by tabular silver halide grains which have an aspect ratio of not less than 5.

DETAILED DESCRIPTION OF THE INVENTION

The terms "monodisperse", "monodispersed", "monodispersity", etc., used with respect to the present invention are defined as the value (coefficient of variation) which is obtained by dividing "dispersion of grain size" (standard deviation) by an average grain size. The "dispersion of grain size" is expressed by a diameter of an equivalent circle obtained from the projected area with respect to a light-sensitive silver halide emulsion mainly composed of tabular grains. The "average grain size" is expressed by an arithmetic average diameter of the grain size in terms of an equivalent circle.

With a silver halide emulsion composed of a group of grains wherein the crystal form is uniform and the dispersion of grain size is small, a grain size distribution thereof shows a standard distribution from which a standard deviation can be easily determined. The distribution of the monodisperse silver halide grains used in the present invention is such that the coefficient of variation is 20% or less and preferably 15% or less.

The term "tabular silver halide grains" used in the present invention means grains having two parallel or substantially parallel planes which are substantially larger than any other planes of the grains and having an aspect ratio of not less than 5, wherein the "aspect ratio" is the ratio of the diameter to the thickness of the tabular silver halide grains.

By the term "diameter of silver halide grains" is meant the diameter of a circle having an area equal to the projected area of the grain when observed with a microscope or an electron microscope. Further, the "thickness" of the grain is defined as the distance between the two parallel planes constituting the tabular silver halide grain.

In the present invention, the diameters of the tabular silver halide grains range from 0.3 μm to 5.0 μm, preferably from 0.6 μm to 3.0 μm, and the thicknesses thereof are 0.4 μm or less, preferably 0.3 μm or less.

As to halide composition of the tabular silver halide grains, any of silver bromide, silver iodide, silver iodobromide, silver chlorobromide, silver chloroiodobromide and silver chloride may be employed, but silver bromide and silver iodobromide are preferred, with the silver iodobromide containing 0 to 30 mol %, more preferably 10 mol % or less, of silver iodide. The crystal structure of the tabular silver halide grains may be uniform, composed of different halide compositions between the inner portion and the outer portion, or may have a layer structure.

Methods for preparation of the tabular silver halide grains are described below.

The tabular silver halide grains generally can be prepared by properly combining methods known to those skilled in the art. For example, a silver salt solution and a halide solution can be added simultaneously while maintaining a comparatively low pBr value of, for example, not more than 1.3, to allow the seed crystals to grow.

The size of the tabular silver halide grains can be adjusted by adjusting temperature, selecting the kind and amount of solvent, and controlling the speed of adding the silver salt and the halide used during growth of the grains.

However, it is difficult to obtain an emulsion composed of monodispersed tabular silver halide grains according to the above-described methods.

Methods for obtaining tabular silver halide grains by conducting the formation of grains in the presence of thioethers are also known as described in Japanese Patent Application (OPI) Nos. 127921/83 (European Pat. No. 84637), 55426/84 (European Pat. 105425), 97134/84 and 99433/84, etc. (the term "OPI" as used herein refers to a "published unexamined Japanese patent application"). The monodispersity of these tabular grains are still insufficient. On the other hand, a method which imparts monodispersity to a silver halide emulsion containing non-tabular twin grains is described, for example, in Japanese Patent Publication No. 45132/84 (U.S. Pat. No. 4,301,241). According to this method it is effective to adjust the speed of adding silver ions and halogen ions at the period of crystal growth to 30% to 100% of the critical crystal growth rate.

As a result of an extensive investigation directed to application of the above-described method to tabular grains having an aspect ratio of not less than 5, it has been found that monodispersed tabular silver halide grains can be prepared under the conditions described below. More specifically, it has been found that monodispersed tabular grains having a coefficient of variation of 20% or less can be prepared by maintaining pBr constant at the initial stage of crystal growth and successively maintaining the speed of adding silver ions and halogen ions near the critical crystal growth rate.

In the above-described condition of preparation, "the initial stage of crystal growth" means a term from a tart of adding silver and halogen ions to form seed crystals of 10% or more with respect to numbers, and is at least one fifth of the total crystal growing time inclusive of a first period of time for crystal growing which takes place after forming seed crystal. It is also necessary to maintain the pBr at the initial stage at not more than 2, preferably in a range of from 0.5 to 1.5. Further, monodispersibility may be improved by simultaneously using a silver halide solvent such as a thioether, a thiourea, etc. It is also necessary to maintain the crystal growth rate at a range near the critical crystal growth rate, i.e., from 50% to 100%, preferably from 60% to 100%, of the critical crystal growth rate.

A rate of adding silver and halogen may be determined depending on a relation between a final size and distribution of grains and other factors, such as a concentration of colloid which is present, solubility of silver halide crystal grains, a magnitude of an agitation in a reaction vessel, size and concentration of crystal which is present at various times, concentration of hydrogen ion and silver ion of an aqueous solution in a reaction vessel, and the like, and conveniently may be determined by a conventional daily experiments.

That is, the upper limit of the adding rate of silver and halogen ions may preferably be settled as a little smaller than the rate which new crystal nuclei may produce. The limit may be easily decided in a practical operation by taking samples from a reaction vessel under various adding rates to find whether new crystal nuclei are formed in the vessel or not. The crystal forming rate at the upper limit of adding rate is called the "critical crystal growing rate".

In a practical operation, a flow rate and concentration of each aqueous solutions containing silver ion and halogen ion respectively may be varied individually or in combination in lieu of the process by varying adding rate thereof.

The tabular silver halide grains according to the present invention can be subjected to chemical sensitization and/or spectral sensitization as described below, if desired.

In the present invention at least one light-sensitive silver halide emulsion layer must contain the tabular grains having an aspect ratio of not less than 5 which occupy at least 50% of the total projected area of the silver halide grains present in the layer. Particularly, it is preferred that tabular grains having an aspect ratio of 5 to less than 30 occupy at least 50% of the total projected area of the silver halide grains present in the layer, and most preferably an aspect ratio of not less than 5 and less than 8.

A preferred thickness of the layer containing the tabular silver halide grains is in the range from 0.5 μm to 6.0 μm, particularly from 0.5 μm to 4.0 μm.

Further, a preferred coating amount of the tabular silver halide grains is in a range from 0.1 $g/m^2$ to 15 $g/m^2$, particularly from 0.3 $g/m^2$ to 12 $g/m^2$.

The silver halide color photographic material of the present invention may contain at least one red-sensitive emulsion layer, at least one green-sensitive emulsion layer and at least one blue-sensitive emulsion layer, and the order of these light-sensitive layers is not particularly restricted and can be determined depending on demands.

Further, as described hereinafter, the silver halide color photographic material of the present invention may contain a dye-forming coupler. Ordinarily, a cyan dye-forming coupler is used in a red-sensitive emulsion layer, a magenta dye-forming coupler is used in a green-sensitive emulsion layer and a yellow dye-forming coupler is used in a blue-sensitive emulsion layer, respectively. However, if desired, a different combination can be employed.

The tabular silver halide grain emulsion can be employed in any of the above-described red-sensitive layer, green-sensitive layer and blue-sensitive layer upon considering the optical properties of the grains. Methods for using tabular grains based on such considerations are described, for example, in *Research Disclosure*, Vol. 225, No. 22534 (January, 1983), *Research Disclosure*, Vol. 253, No. 25330 (May, 1985), etc.

The emulsion layer containing the tabular silver halide grains according to the present invention and other emulsion layers may contain conventional silver halide grains other than the tabular silver halide grains. Any of silver bromide, silver iodobromide, silver iodochlorobromide, silver chlorobromide and silver chloride may be used as the non-tabular silver halide. Preferred silver halides are silver iodobromide or silver iodochlorobromide each containing about 30 mol % or less of silver iodide. Silver iodobromide containing 15 mol % or less of silver iodide is particularly preferred.

The silver halide grains may have a regular crystal structure, for example, a cubic, octahedral or tetradecahedral structure, etc., an irregular crystal structure, for example, a spherical structure, etc., a crystal defect, for example, a twin plane, etc., or a composite structure thereof. In addition, mixtures of silver halide grains having these different crystal structures may be used.

The grain size of the grains may be varied and ranges from fine grains having about 0.1 micron or less to large size grains having about 10 microns of a diameter of projected area. Further, a monodispersed emulsion having a narrow grain size distribution and a polydispersed emulsion having a broad grain size distribution may be used.

The above-described silver halide photographic emulsions can be prepared using known methods, for example, those described in *Research Disclosure,* Vol. 176, No. 17643 (December, 1978), pages 22 and 23, "I. Emulsion Preparation and Types" and *Research Disclosure,* Vol. 187, No. 18716 (November, 1979), page 648, etc.

Photographic emulsions as used in the present invention can be prepared in any suitable mannrr, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and combinations thereof. In addition, there can be employed a method (so-called "reversal mixing process") in which silver halide particles are formed in the presence of an excess of silver ions.

As one system of the double jet process, a so-called "controlled double jet process" in which the pAg in a liquid phase where silver halide is formed is maintained at a predetermined level can be employed. This process can produce a silver halide emulsion in which the crystal form is regular and the grain size is nearly uniform.

Moreover, photographic emulsions may be subjected to physical ripening in the presence of known silver halide solvents (for example, ammonia, potassium thiocyanate, and thioethers and thione compounds as described in U.S. Pat. No. 3,271,157, Japanese Patent Application (OPI) Nos. 82408/78, 144319/78 (British Pat. No. 1,586,412), 100717/79 (U.S. Pat. No. 4,298,683) and 155828/79 (U.S. Pat. No. 4,276,374), etc.). According to these methods, silver halide emulsions in which the crystal form is regular and the grain size is nearly uniform can also be obtained.

Silver halide emulsions composed of regular grains as described above can be obtained by controlling pAg and pH during the step of formation of silver halide grains. The details thereof are described in, for example, *Photographic Science and Engineering,* Vol. 6, pages 159 to 165 (1962), *Journal of Photographic Science,* Vol. 12, pages 242 to 251 (1964), U.S. Pat. No. 3,655,394, British Pat. No. 1,413,748, etc.

Representative non-tabular monodispersed emulsions of the present invention are those comprising silver halide grains having an average grain size of about 0.1 micron or more and at least 95% by weight of the total silver halide grains having a size within the range of ±40% of the average grain size. In the present invention, it is preferred to employ a non-tabular monodispersed emulsion comprising silver halide grains having an average grain size of from 0.25 micron to 2 microns and at least 95% by weight or by number of particles of the total silver halide grains having a size within the range of ±20% of the average grain size. Methods for preparation of such non-tabular monodispersed emulsions are described in U.S. Pat. Nos. 3,574,628 and 3,655,394, British Pat. No. 1,413,748, etc. Further, monodispersed emulsions as described in Japanese Patent Application (OPI) Nos. 39027/76 (U.S. Pat. No. 4,067,739), 83097/76 (British Pat. No. 1,528,789), 137133/78 (British Pat. No. 1,581,963), 48521/79, 99419/79 (U.S. Pat. No. 4,289,843), 37635/83 and 49938/83 (U.S. Pat. No. 4,497,895), etc., can be preferably employed in the present invention.

The crystal structure of the silver halide grains may be uniform, composed of different halide compositions between the inner portion and the outer portion, or may have a layer structure. Examples of such emulsion grains are described in British Pat. No. 1,027,146, U.S. Pat. Nos. 3,505,068 and 4,444,877, and Japanese Patent Application (OPI) No. 143331/85, etc.

Further, the silver halide emulsions in which silver halide grains having different compositions are connected upon epitaxial junctions or silver halide emulsions in which silver halide grains are connected with compounds other than silver halide such as silver thiocyanate, lead oxide, etc., may also be employed. Examples of these emulsion grains are described in U.S. Pat. No. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84 (U.S. Pat. No. 4,463,087 and 4,471,050), etc.

During the step of formation or physical ripening of the silver halide grains, cadmium salts, zinc salts, lead salts, thallium salts, iridium salts or complex salts thereof, rhodium salts or complex salts thereof, iron salts or complex salts thereof, etc., may be allowed to coexist.

The silver halide emulsions used in the present invention may be those of surface latent image type in which latent images are formed mainly on the surface thereof, those of internal latent image type in which latent images are formed mainly in the interior thereof, or those in which latent images are formed both on the surface and in the interior thereof.

For removal of soluble silver salts from the emulsion prior to or after physical ripening, a noodle washing process, a flocculation process or an ultrafiltration process, etc., can be employed.

The photographic emulsions used in the present invention are usually conducted with physical ripening, chemical ripening and spectral sensitization. Various kinds of additives which can be employed in these steps are described in *Research Disclosure,* No. 17643 (December, 1978) and No. 18716 (November, 1979) as mentioned above, and concerned items thereof are summarized in the table shown below.

Further, known photographic additives which can be used in the present invention are also described in the above mentioned *Research Disclosure,* No. 17643 and *Research Disclosure,* No. 18716 and various items disclosed therein which can be used in the present invention are summarized in Table A below.

TABLE A

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |

TABLE A-continued

| Kind of Additives | RD 17643 | RD 18716 |
|---|---|---|
| 3. Spectral Sensitizers and Supersensitizers | Pages 23 to 24 | Page 648, right column to page 649, right column |
| 4. Whitening Agents | Page 24 | — |
| 5. Antifoggants and Stabilizers | Pages 24 to 25 | Page 649, right column |
| 6. Light Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* No. 17643, "VII-C" to "VII-G". As dye forming couplers, couplers capable of providing three primary colors (i.e., yellow, magenta and cyan) in the subtractive process upon color development are important. Specific examples of preferred diffusion resistant hydrophobic, 4-equivalent or 2-equivalent couplers are described in the patents cited in *Research Disclosure,* No. 17643, "VII-C" and "VII-D" as mentioned above. In addition, couplers as described below are preferably employed in the present invention.

Typical yellow couplers which can be used in the present invention are hydrophobic acylacetamide type couplers having a ballast group. Specific examples thereof are described in U.S. Pat. Nos. 2,407,210, 2,875,027 and 3,265,506, etc.

In the present invention 2-equivalent yellow couplers are preferably employed. Typical examples of 2-equivalent yellow couplers include the oxygen atom-releasing type as described in U.S. Pat. Nos. 3,408,194, 3,447,928, 3,933,501 and 4,022,620, etc., and the nitrogen atom releasing type as described in Japanese Patent Publication No. 10739/83, U.S. Pat. No. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzoylacetanilide type couplers are characterized by their good color forming properties to provide a high color density.

Magenta couplers for use in the present invention include hydrophobic indazolone type couplers and cyanoacetyl type couplers. Preferably 5-pyrazolone type couplers and pyrazoloazole type couplrs, each having a ballast group, are used. Of the 5-pyrazolone type couplers, those substituted with an arylamino group or an acylamino group at the 3-position thereof are preferred in view of hue of dyes formed and color density. Typical examples thereof are described in U.S. Pat. Nos. 2,311,082, 2,343,703, 2,600,788, 2,908,573, 3,062,653, 3,152,896, 3,936,015, etc. As releasing groups for 2-equivalent 5-pyrazolone type couplers, nitrogen atom-releasing groups as described in U.S. Pat. No. 4,310,619 and arylthio groups as described in U.S. Pat. No. 4,351,897 are.particularly preferred. Further, 5-pyrazolone type couplers having a ballast group as described in European Pat. No. 73,636 are advantageous since they provide high color density.

Examples of pyrazoloazole type couplers include pyrazolobenzimidazoles as described in U.S. Pat. No. 3,061,432, and preferably pyrazolo[5,1-c][1,2,4]triazoles as described in U.S. Pat. No. 3,725,067, pyrazolotetrazoles as described in *Research Disclosure,* No. 24220 (June, 1984) and Japanese Patent Application (OPI) No. 33552/85 and pyrazolopyrazoles as described in *Research Disclosure,* No. 24230 (June, 1984) and Japanese Patent Application (OPI) No. 43659/85. Imidazo[1,2-b]pyrazoles as described in U.S. Pat. No. 4,500,630 are preferred and pyrazolo[1,5-b][1,2,4]triazoles as described in European Pat. No. 119,860A are particularly preferred in view of the lower yellow subsidiary absorption and superior light fastness of the dyes that are formed.

Cyan couplers for use in the present invention include hydrophobic naphthol type and phenol type couplers having a ballast group. Typical examples thereof include naphthol type couplers as described in U.S. Pat. No. 2,474,293 and preferably oxygen atom-releasing type 2-equivalent naphthol type couplers as described in U.S. Pat. Nos. 4,952,212, 4,146,396, 4,228,233, 4,296,200, etc. Specfic examples of phenol type couplers are described in U.S. Pat. Nos. 2,369,929, 2,801,171, 2,772,162, 2,895,826, etc.

Cyan couplers fast to humidity and temperatures are preferably used in the present invention. Typical examples thereof include phenol type cyan couplers having alkyl groups larger than methyl groups at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, European Pat. No. 121,365, etc., phenol type couplers having a phenylureido group at the 2-position thereof and an acylamino group at the 5-position thereof as described in U.S. Pat. Nos. 3,446,622, 4,333,999, 4,451,559, 4,427,767, etc.

It is preferred to use colored couplers together in color negative photographic light-sensitive materials for photographing in order to correct undesirable absorptions of the dyes that are formed. Typical examples of colored couplers include yellow colored magenta couplers as described in U.S. Pat. No. 4,163,670, Japanese Patent Publication No. 39413/82, etc., and magenta colored cyan couplers as described in U.S. Pat. Nos. 4,004,929 and 4,138,258, British Pat. No. 1,146,368, etc. Other examples of useful colored couplers are described in *Research Disclosure,* No. 17643, "VII-G" as mentioned above.

Further, couplers capable of forming appropriately diffusible dyes can be used together in order to improve graininess. Specific examples of such types of magenta couplers are described in U.S. Pat. No.4,366,237, British Pat. No. 2,125,570, etc., and those of yellow, magenta and cyan couplers are described in European Pat. No. 96,570, West German Patent Application (OLS) No. 3,234,533, etc.

Dye-forming couplers and the above-described special couplers may form polymers including dimers or more. Typical examples of polymerized dye-forming couplers are described in U.S. Pat. Nos. 3,451,820, 4,080,211, etc. Specific examples of polymerized magenta couplers are described in British Pat. No. 2,102,173, U.S. Pat. No. 4,367,282, etc.

Couplers capable of releasing a photographically useful residue during the course of coupling can be also employed preferably. Specific examples of useful DIR couplers capable of releasing a development inhibitor are described in the patents cited in *Research Disclosure,* No. 17643, "VII-F" described above.

Of the DIR couplers, those of the deactivation type (which deactivate in a developing solution) as represented by Japanese Patent Application (OPI) No. 151944/82, those of the timing type as represented by U.S. Pat. No. 4,248,962 and Japanese Patent Application (OPI) No. 154234/82 (U.S. Pat. No. 4,421,845) and those of the reactive type as represented by Japanese Patent Application (OPI) No. 184248/85 are preferably employed in combination with the present invention. Further, the DIR couplers of the deactivation type (which deactivate in a developing solution) as described in Japanese Patent Application (OPI) Nos. 151944/82 (U.S. Pat. No. 4,477,563), 217932/83 (European Pat. No. 96,873), 218644/85, 225156/85, 233650/85, etc., and the DIR couplers of the reactive type as described in Japanese Patent Application (OPI) No. 184248/85, etc., are particularly preferred.

The couplers which can be used in the present invention can be incorporated into photographic light-sensitive materials using varius known dispersing methods. Typical examples thereof include a solid dispersing method, an alkali dispersing method, preferably a latex dispersing method and more preferably an oil droplet in water type dispersing method. By means of the oil droplet in water type dispersing method, compounds are dissolved in either an organic solvent having a high boiling point of 175° C. or more, an auxiliary solvent having a low boiling point, or a mixture thereof and then the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc. The dispersion may be formed through phase inversion. Further, prior to using the dispersions for coating, the amount of the auxiliary solvent therein can be reduced or the auxiliary solvent can be removed by distillation, noodle washing or ultrafiltration, etc., if desired.

The processes and effects of latex dispersing methods and the specific examples of latexes for loading are described in U.S. Pat. No. 4,199,363, West German Patent Application (OLS) Nos. 2,541,274, 2,541,230, etc.

The photographic light-sensitive material according to the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

In the photographic light-sensitive material of the present invention, various color fading preventing agents can be employed. Typical examples of organic color fading preventing agents include hindered phenols, for example, hydroquinones, 6-hydroxychromans, 5-hydroxycoumarans, spirochromans, p-alkoxyphenols, bisphenols, gallic acid derivatives, methylenedioxybenzenes, aminophenols, hindered amines, or ether or ester derivatives thereof derived from each of these compounds by silylation or alkylation of the phenolic hydroxy group or the amino group thereof. Further, metal complexes represented by (bissalicylaldoximate) nickel complexes and (bis-N,N-dialkyldithiocarbamate) nickel complexes may be employed.

It is preferred in the photographic light-sensitive material according to the present invention that a subsidiary layer, for example, a protective layer, an intermediate layer, a filter layer, an antihalation layer, a back layer, etc., is appropriately provided in addition to the silver halide emulsion layer.

The photographic emulsion layers and other layers of the photographic light-sensitive material according to the present invention are coated on a flexible support such as a plastic film, paper, cloth, etc., or a rigid upport such as glass, ceramic, metal, etc., usually used for photographic light-sensitive materials. Useful flexible supports include cellulose derivatives (for example, cellulose nitrate, cellulose acetate, cellulose acetate butyrate, etc.), synthetic polymers (for example, polystyrene, polyvinyl chloride, polyethylene terephthalate, polycarbonate, etc.) and paper coated or laminated with a baryta layer or an α-olefin polymer (for example, polyethylene, polypropylene, an ethylene-butene copolymer, etc.), etc.

Supports may be colored with dyes or pigments. Further, they may be rendered black for the purpose of shielding light. The surfaces of these supports are, in general, subjected to a subbing treatment in order to increase adhesiveness to photographic emulsion layers, etc. Before or after receiving the subbing treatment, the surfaces of the supports may be subjected to a glow discharge treatment, a corona discharge treatment, an ultraviolet irradiation treatment, a flame treatment, or so on.

In order to coat photographic emulsion layers and other hydrophilic colloid layers, various known coating methods, for example, a dip coating method, a roller coating method, a curtain coating method, an extrusion coating method, etc., can be utilized. Two or more layers may be simultaneously coated using the coating methods as described in U.S. Pat. Nos. 2,681,294, 2,761,791, 3,526,528, 3,508,947, etc., if desired.

The color photographic light-sensitive material according to the present invention can be subjected to development processing in a conventional manner as described in *Research Disclosure,* No. 17643, pages 28 to 29 and *Research Disclosure,* No. 18716, page 651, left column to right column. After development, bleach-fixing or bleaching and fixing, the color photographic material according to the present invention is usually subjected to a water washing process or a stabilizing process.

The water washing step is generally conducted by a countercurrent water washing step using two or more tanks in order to reduce the amount of water used. As a stabilizing process, a representative example is a multistage countercurrent stabilizing process as described in Japanese Patent Application (OPI) No. 8543/82 (U.S. Pat. No. 4,336,324), in place of the water washing step. In this step two to nine tanks of countercurrent baths are necessary. To the stabilizing bath various kinds of compounds are added for the purpose of stabilizing images formed. Representative examples of the additives include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., being used in combination) for the purpose of adjusting the pH of the layers (for example, pH of 3 to 8), and formalins, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazolinones, isothiazolones, 4-thiazolinebenzimidazoles, halogenated phenols, etc.), surface active agents, fluorescent whitening agents, hardeners, etc., may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agents for the various layers.

The present invention can be applied to various color photographic light-sensitive materials. Representative examples include color negative films for general use or movies, color reversal films for slides or television, color paper, color positive films, color reversal paper, etc. The present invention can also be applied to black-and-white photographic light-sensitive materials utilizing a mixture of three color couplers as described in *Research Disclosure,* No. 17123 (July, 1978), etc.

The present invention is described in detail with reference to the following examples, but the present invention is not to be construed as being limited thereto. In the following examples, all units, ratios, percentages, etc., are by weight unless otherwise indicated.

EXAMPLE 1

30 g of gelatin and 10.3 of potassium bromide were added to 1 liter of water and the resulting solution was kept in a vessel at 60° C. (pBr: 1.3, pH: 6.5) with stirring. To the vessel, a 1 M/liter aqueous solution of silver nitrate and a 1 M/liter aqueous solution containing potassium bromide and potassium iodide were simultaneously added over 15 seconds at a rate of 120 ml/minute, and then the same solutions were simultaneously added thereto over 60 minutes at a rate of 10 ml/minute according to a double jet method.

The tabular silver halide grains thus obtained were composed of silver iodobromide grains containing 2.5 mol % of silver iodide and having a grain size distribution of 27% as the coefficient of variation, with grains having an aspect ration of 35 or more being 50% or more of the total projected area of the silver halide grains present. The emulsion was subjected to chemical sensitization using together gold and sulfur. The tabular silver halide emulsion thus obtained was designated Emulsion A.

In the same manner as described with respect to Emulsion A, the first addition of the aqueous solution of silver nitrate and the aqueous solution containing potassium bromide and potassium iodide was conducted. Then, the aqueous solution of silver nitrate and the aqueous solution containing potassium bromide and potassium iodide were further added according to a controlled double jet method while maintaining a pBr of 1.3. More specifically, the aqueous solution of silver nitrate and the aqueous solution containing potassium bromide and potassium iodide each having a concentration of 1/6 M/liter, ¼ M/liter, ⅓ M/liter, ½ M/liter, or ⅔ M/liter were added in this order at a rate of 10 ml/minute. The total amount of silver added and the total addition time were adjusted so as to be the same as in Emulsion A.

The crystal growth rate during the crystal growth period was controlled at 50 to 60% of the critical crystal growth rate to prepare Emulsion B. Further, the crystal growth rate during the crystal growth period controlled at 60 to 85% of the critical crystal growth rate to prepare Emulsion C. These emulsions were subjected to chemical sensitization using together gold and sulfur as described with respect to Emulsion A.

Emulsions B and C each were composed of tabular silver iodobromide grains containing 2.5 mol % of silver iodide with grains having an aspect ratio of 5 or more being 50% or more of the total projected area of the silver halide grains present. The grain size distributions of Emulsion B and Emulsion C were 18% and 17% as the coefficients of variation, respectively.

On a triacetate film support were coated the following emulsion layer and protective layer to prepare a sample.

Emulsion Layer:

100 g of α-(pivaloyl)-α-(1-benzyl-5-ethoxy-3-hydantoinyl)-2-chloro-5-dodecyloxycarbonylacetanilide, as a yellow coupler, was dissolved in 100 ml of tricresyl phosphate and 100 ml of ethyl acetate and the resulting solution was mixed at high speed stirring with 1 kg of a 10% aqueous solution of gelatin to prepare a coupler emulsion. 1,000 g of the coupler emulsion thus obtained was mixed with 1 kg of the above-described tabular silver iodobromide Emulsion A and the resulting coating solution was coated on a support to form a dry layer thickness of 3 μm (silver amount 2.0 g/m$^2$)

Protective Layer.

Gelatin, water, a gelatin hardener and a coating aid were mixed and the resulting solution was coated on the emulsion layer to form a dry layer thickness of 2 μm.

The sample thus prepared was designated Sample 101 which was a comparative sample.

Further, Samples 102 and 103 were prepared in the same manner as described for Sample 101 except using the tabular Emulsions B and C in place of Emulsion A, respectively.

The samples thus obtained were exposed through a continuous wedge using a white light source of 4,800° K, and then subjected to the two kinds of development processing described below to obtain color images. The processing steps and the processing solutions employed were as follows.

| Processing (1) | Temperature (°C.) | Time |
|---|---|---|
| Color Development | 38 | 3 min 15 sec |
| Bleach-Fixing | 38 | 6 min |
| Washing with Water | 38 | 3 min 15 sec |
| Stabilizing | 38 | 3 min 15 sec |
| Drying | | |

The compositions of the processing solutions used for the above processing steps were as follows.

| Color Developing Solution: | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl—N—β-hydroxyethylamino)-2-methylaniline Sulfate | 4.5 g |

-continued

| | |
|---|---|
| Water to make | 1 liter |
| Bleach-Fixing Solution: | |
| Iron (III) Ammonium Ethylenediamine-tetraacetate (dihydrate) | 100.0 g |
| Disodium Ethylenediaminetetraacetate | 5.0 g |
| Ammonium Thiosulfate (70% aq. soln.) | 200.0 ml |
| Sodium Sulfite | 10.0 g |
| Water to make | 1 liter |
| pH: | 6.5 |
| Stabilizing Solution: | |
| Formalin | 8 ml |
| Water to make | 1 liter |

| Processing (2) | Time (min) | Temperature (°C.) |
|---|---|---|
| First Development | 6 | 38 |
| Washing with Water | 2 | 38 |
| Reversal | 2 | 38 |
| Color Development | 6 | 38 |
| Control | 2 | 38 |
| Bleaching | 6 | 38 |
| Fixing | 4 | 38 |
| Washing with Water | 4 | 38 |
| Stabilizing | 1 | Room Temperature |
| Drying | | |

The compositions of processing solutions used for the above-described processing steps were as follows:

| | |
|---|---|
| First Developing Solution: | |
| Water | 700 ml |
| Pentasodium Salt of Nitrilo-N,N,N—trimethylenephosphonic Acid | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1,000 ml |
| Reversal Solution: | |
| Water | 700 ml |
| Pentasodium Salt of Nitrilo-N,N,N—trimethylenephosphonic Acid | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developing Solution: | |
| Water | 700 ml |
| Pentasodium Salt of Nitrilo-N,N,N—trimethylenephosphonic Acid | 3 g |
| Sodium Sulfite | 7 g |
| Sodium Tertiary Phosphate (12 hydrate) | 36 g |
| Potassium Bromide | 1 g |
| Potassium Iodide (0.1% aq. soln.) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |

-continued

| | |
|---|---|
| 3,6-Dithiaoctane-1,8-diol | 1 g |
| Water to make | 1,000 ml |
| Control Solution: | |
| Water | 700 ml |
| Sodium Sulfite | 12 g |
| Sodium Ethylenediaminetetraacetate (dihydrate) | 8 g |
| Thioglycerol | 0.4 ml |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2 g |
| Iron (III) Ammonium Ethylenediamine-tetraacetate (dihydrate) | 120 g |
| Potassium Bromide | 100 g |
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formalin (37 wt % formaldehyde) | 5.0 ml |
| Fuji Driwel (aqueous surface active agent solution, manufactured by Fuji Photo Film Co., Ltd.) | 5.0 ml |
| Water to make | 1,000 ml |

Samples processed as described above were measured for optical density through a blue filter and the sensitivity was determined using the reciprocal of the exposure amount required for obtaining a fixed yellow density (D=1.0).

Further, the slope of the characteristic curve passing through two points having the densities of 0.2 and 1.0, respectively, was indicated as gamma.

The results thus obtained are shown in Table 1.

TABLE 1

| Sample No. | Emulsion | Average* Aspect Ratio | Coefficient of Variation (%) | Processing (1) Relative Sensitivity | Processing (1) Gamma | Processing (2) Relative Sensitivity | Processing (2) Gamma |
|---|---|---|---|---|---|---|---|
| 101 (Comparison) | A (Tabular) | 35 | 27 | 102 | 0.8 | 99 | 1.0 |
| 102 (Invention) | B (Tabular) | 34 | 18 | 100 | 1.0 | 101 | 1.5 |
| 103 (Invention) | C (Tabular) | 25 | 17 | 101 | 1.1 | 102 | 1.6 |

*Average aspect ratio: The value of the aspect ratio when the total projected area of silver halide grains having an aspect ratio not less than this value is 50% or more of the total projected area of all the silver halide grains present.

From the results shown in Table 1, it is apparent that the samples using the tabular silver halide grains according to the present invention (Samples 102 and 103) exhibit higher gamma than the sample using conventional tabular silver halide grains (Sample 101) for both negative type and reversal type processing and thus they have excellent photographic properties.

EXAMPLE 2

Spherical silver iodobromide grains (containing 2.5 mol % of silver iodide) were prepared in the presence of ammonia according to a double jet method. The silver iodobromide grains thus obtained had an average grain size of 1.2 μm and a coefficient of variation of 15%. The emulsion comprising the resulting grains was then subjected to chemical sensitization using together gold and sulfur and the silver halide emulsion thus obtained was designated Emulsion D.

A triacetate film support was coated with the first to thirteenth layers described below, in sequential order, using Emulsion D to prepare a color reversal photographic light-sensitive material which was designated Sample 201.

First Layer: Antihalation Layer 15 g of 5-chloro-2-(2-hydroxy-3,5-di-tert-butylphenyl)-2H-benzotriazole, 30 g of 2-(2-hydroxy-5-tert-butylphenyl)- 2H-benzotriazole, 35 g of 2-(2-hydroxy-3-sec-butyl-5-tert-butylphenyl)-2H-benzotriazole, and 100 g of dodecyl-5-(N,N-diethylamino)-2-benzenesulfonyl-2,4-pentadienoate, as ultraviolet ray absorbing agents, 00 ml of tricresyl phosphate, 200 ml of ethyl acetate, 20 g of sodium dodecylbenzenesulfonate and a 10% aqueous solution of gelatin were stirred at a high speed to prepare an emulsion (the resulting emulsion will hereinafter be referred to as "Emulsion (a)"). The emulsion thus obtained was mixed with a 10% aqueous solution of gelatin, black colloidal silver, water and a coating aid, and the resulting mixture was then coated to form a dry layer thickness of 2 μm.

Second Layer: Gelatin Intermediate Layer 2,5-Di-tert-octylhydroquinone was dissolved in 100 ml of dibutyl phthalate and 100 ml of ethyl acetate and stirred at a high speed together with 1 kg of a 10% aqueous solution of gelatin to prepare an emulsion (the resulting emulsion will hereinafter be referred to as "Emulsion (b)"). 2 kg of the emulsion thus obtained was mixed with 1.5 kg of a 10% aqueous solution of gelatin, and the resulting mixture was then coated so as to form a dry layer thickness of 1 μm.

Third Layer: Low-Sensitive Red-Sensitive Emulsion Layer 100 g of a cyan coupler, i.e., 2-(heptafluorobutyramido)-5-[2'-(2",4"-di-tert-amylphenoxy)-butyramido]-phenol was dissolved in 100 ml of tricresyl phosphate and 100 ml of ethyl acetate and stirred at a high speed together with 1 kg of a 10% aqueous solution of gelatin to prepare an emulsion (the resulting emulsion will hereinafter be referred to as "Emulsion (c)"). 500 g of the emulsion thus obtained was mixed with 1 kg of a red-sensitive silver iodobromide emulsion (containing 70 g of silver and 60 g of gelatin, and having an iodide content of 4 mol %), and the resulting mixture was then coated so as to form a dry layer thickness of 1 μm (silver amount: 0.5 g/m$^2$).

Fourth Layer: High-Sensitive Red-Sensitive Emulsion Layer

Emulsion (c) was mixed with 1 kg of a red-sensitive silver iodobromide emulsion (containing 70 g of silver and 60 g of gelatin, and having an iodide content of 2.5 mol %), and the resulting mixture was then coated so as to form a dry layer thickness of 2.5 μm (silver amount: 0.8 g/m$^2$).

Fifth Layer: Intermediate Layer 1 kg of Emulsion (b) was mixed with 1 kg of a 10% aqueous solution of gelatin, and the resulting mixture was then coated so as to form a dry layer thickness of 1 μm.

Sixth Layer: Low-Sensitive Green-Sensitive Emulsion Layer

An emulsion was prepared in the same manner as described with respect to the preparation of the emulsion for the third layer, except that a magenta coupler, i.e., 1-(2,4,6-trichlorophenyl)-3-[3-(2,4-di-tert-amylphenoxyacetamido)benzamido]-5-pyrazolone, was used in place of the cyan coupler (the resulting emulsion will hereinafter be referred to as "Emulsion (d)"). 300 g of the emulsion thus obtained was mixed with 1 kg of a green-sensitive silver iodobromide emulsion (containing 70 g of silver and 60 g of gelatin and having an iodine content of 3 mol %), and the resulting mixture was then coated so as to form a dry layer thickness of 2.0 μm (silver amount: 0.7 g/m$^2$).

Seventh Layer: High-Sensitive Green-Sensitive Emulsion Layer 1,000 g of Emulsion (d) was mixed with 1 kg of a green-sensitive silver iodobromide emulsion (containing 70 g of silver and 60 g of gelatin and having an iodine content of 2.5 mol %), and the resulting mixture was then coated so as to form a dry layer thickness of 2.0 μm (silver amount: 0.7 g/m$^2$).

Eighth Layer: Gelatin Intermediate Layer 1 kg of Emulsion (b) was mixed with 1 kg of a 10% aqueous solution of gelatin, and the resulting mixture was then coated so as to form a dry layer thickness of 0.5 μm.

Ninth Layer: Yellow Filter Layer

An emulsion containing yellow colloidal silver was coated so as to form a dry layer thickness of 1 μm.

Tenth Layer: Low-Sensitive Blue-Sensitive Emulsion Layer

An emulsion was prepared in the same manner as described in the preparation of the emulsion for the third layer except that a yellow coupler, i.e., α-(pivaloyl)-α-(1-benzyl-5-ethoxy-3-hydantoinyl)-2-chloro-5-dodecyloxycarbonylacetanilide, was used in place of the cyan coupler (the resulting emulsion will hereinafter be referred to as "Emulsion (e)"). 1,000 g of the emulsion thus obtained was mixed with 1 kg of a blue-sensitive silver iodobromide emulsion (containing 70 g of silver and 60 g of gelatin and having an iodine content of 2.5 mol %) and the resulting mixture was then coated so as to form a dry layer thickness of 1.5 μm (silver amount: 0.6 g/m$^2$).

Eleventh Layer: High-Sensitive Blue-Sensitive Emulsion Layer 1,000 g of Emulsion (e) was mixed with 1 kg of the above-described Emulsion D (containing 70 g of silver and 60 g of gelatin and having an iodine content of 2.5 mol %), and the resulting mixture was then coated so as to form a dry layer thickness of 3 μm (silver amount: 1.1 g/m$^2$).

Twelfth Layer: Second Protective Layer

Emulsion (a) was mixed with a 10% aqueous solution of gelatin, water and a coating aid, and the resulting mixture was then coated so as to form a dry layer thickness of 2 μm.

Thirteenth Layer: First Protective Layer

A 10% aqueous solution of geltin containing a surface fogged fine grain silver iodobromide emulsion (grain size: 0.06 μm; iodide content: 1 mol %) was coated so that the amount of silver coated was 0.1 g/m$^2$ and the dry layer thickness was 0.8 μm.

In each of the above-described layers were further incorporated 1,4-bis(vinylsulfonylacetamido)ethane, as a gelatin hardening agent, and a surface active agent in addition to the above-described compounds.

Further, samples were prepared in the same manner as described for Sample 201, except using Emulsions A to C described in Example 1 above in place of Emulsion D and the samples thus obtained were designated Samples 202 to 204, respectively.

Moreover, Emulsions E, F, E' and F' were prepared in the same manner as described for Emulsion C, except that the pBr was varied and 10 ml of a 5 wt % aqueous solution of $HO(CH_2)_2S(CH_2)_2S(CH_2)_2OH$ was added during the stage of grain formation. Samples 205, 206, 207 and 208 were prepared in the same manner as described for Sample 201, except using Emulsions E, F, E' and F' in place of Emulsion D.

The sample number, the emulsion employed, the average aspect ratio and coefficient of variation thereof are summarized in Table 2 below The samples thus obtained (Samples 201 to 206) were exposed to white light at an exposed surface illumination of 1,000 lux through a pattern for measuring graininess and a pattern for measuring sharpness using a light source of 4,800° K and then subjected to development processing according to Processing (2) described above to obtain color images.

The samples thus processed were measured to determine the graininess of the yellow image and the sharpness of the magenta and cyan images. The graininess (RMS graininess) was shown using a value obtained by multiplying a standard deviation of variation in density obtained from scanning with a microdensitometer by 1,000. Further, the sharpness was evaluated by an MTF value.

In Table 2 below, the RMS values at a density of 1.0 and the MTF values at a frequency of 25 lines per 1 mm are set forth.

Furthermore, the same exposure to light and development processing as described above were conducted with the samples, except using a wedge for sensitometry in place of the patterns for measuring graininess and sharpness. The optical density of the yellow image thus obtained was measured through a blue filter and the sensitivity was determined using the reciprocal of the exposure amount required for obtaining a fixed yellow density (D = 1.0).

The results thus obtained are shown in Table 2.

TABLE 2

| Sample No. | Used in High-Sensitive Blue-Sensitive Emulsion Layer | Coefficient of Variation | Average* Aspect Ratio | Relative Sensitivity (D = 1.0) | Graininess (D = 1.0) | Sharpness (25 cycles/mm) Magenta Image | Sharpness (25 cycles/mm) Cyan Image |
|---|---|---|---|---|---|---|---|
| 201 (Comparison) | D (Spherical) | 15 | — | 100 | 26.2 | 0.60 | 0.42 |
| 202 (Comparison) | A (Tabular) | 27 | 35 | 99 | 32.5 | 0.68 | 0.56 |
| 203 (Invention) | B (Tabular) | 18 | 34 | 101 | 25.9 | 0.68 | 0.55 |
| 204 (Invention) | C (Tabular) | 17 | 25 | 102 | 25.5 | 0.67 | 0.56 |
| 205 (Invention) | E (Tabular) | 14 | 14 | 103 | 24.8 | 0.69 | 0.55 |
| 206 (Invention) | F (Tabular) | 17 | 13 | 102 | 25.0 | 0.67 | 0.56 |
| 207 (Invention) | E' (Tabular) | 18 | 7 | 102 | 24.3 | 0.68 | 0.56 |
| 208 (Invention) | F' (Tabular) | 13 | 6 | 103 | 24.0 | 0.69 | 0.55 |

*As defined in Table 1.

From the results shown in Table 2, it is understood that the sharpness of Sample 202 in which the tabular Emulsion A is employed in the high-sensitive blue-sensitive emulsion layer is greatly improved as compared with Sample 201 using the spherical Emulsion D in the layer. However, the graininess of Sample 202 is reduced in comparison with Comparative Sample 201.

In contrast, in Samples 203 to 208 using Emulsions B, C, E, F, E' and F', respectively, the sharpness is greatly improved without a decrease in graininess.

These results demonstrate that it is possible to greatly improve the sharpness without an accompanying degradation of graininess by using the tabular silver halide emulsion having monodispersity according to the present invention in a color reversal photographic light-sensitive material.

EXAMPLE 3

Emulsions G to J were prepared in the same manner as described with respect to Emulsions D, A, B and C, respectively, except that the content of silver iodide was changed from 2.5 mol % to 7.0 mol %. Further, Emulsions K to N were prepared in the same manner as described with respect to Emulsions G to J, except they were spectrally sensitized so that they had green sensitivity, respectively.

Using the above emulsions, a multilayer color photographic light-sensitive material was prepared by forming the layers having the following compositions on a triacetyl cellulose film support.

First Layer: Antihalation Layer

A gelatin layer containing black colloidal silver.

Second Layer: Intermediate Layer

A gelatin layer containing an emulsified dispersion of 2,5-di-tert-octylhydroquinone.

Third Layer: First Red-Sensitive Emulsion Layer

A silver iodobromide emulsion (iodide content: 5 mol %), silver coated amount: 1.6 g/m$^2$ Red-Sensitive Sensitizing Dye Coupler EX-1: 0.04 mol per mol of silver Coupler EX-3: 0.003 mol per mol of silver Coupler EX-9: 0.0006 mol per mol of silver Fourth Layer: Second Red-Sensitive Emulsion Layer A silver iodobromide emulsion (iodide content: 10 mol %), silver coated amount: 1.4 g/m$^2$ Red-Sensitive Sensitizing Dye Coupler EX-1: 0.002 mol per mol of silver Coupler EX-2: 0.02 mol per mol of silver Coupler EX-3: 0.0016 mol per mol of silver Fifth Layer: Intermediate Layer Same as the Second Layer Sixth Layer: First Green-Sensitive Emulsion Layer A silver iodobromide emulsion (iodide content: 4 mol %), silver coated amount: 1.2 g/m$^2$ Green-Sensitive Sensitizing Dye Coupler EX-4: 0.05 mol oer mol of silver Coupler EX-5: 0.008 mol per mol of silver Coupler EX-9: 0.0015 mol per mol of silver Seventh Layer: Second Green-Sensitive Emulsion Layer The above-described green-sensitive Emulsions K to N (having the properties shown in Table 3 below), silver coated amount: 1.3 g/m$^2$ Coupler EX-7: 0.017 mol per mol of silver Coupler EX-6: 0.003 mol per mol of silver Coupler EX-10: 0.0003 mol per mol of silver Eighth Layer: Yellow Filter Layer A gelatin layer containing yellow colloidal silver and an emulsified dispersion of 2,5-di-tert-octylhydroquinone.

Ninth Layer: First Blue-Sensitive Emulsion Layer

A silver iodobromide emulsion (iodide content: 6 mol %), silver coated amount: 0.7 g/m$^2$ Coupler EX-8: 0.25 mol per mol of silver Coupler EX-9: 0.015 mol per mol of silver Tenth Layer: Second Blue-Sensitive Emulsion Layer The above-described Emulsions G to J (having the properties shown in Table 3 below), silver coated amount: 0.6 g/m$^2$ Coupler EX-8: 0.06 mol per mol of silver Eleventh Layer: First Protective Layer A gelatin layer containing silver iodobromide (iodide content: 1 mol %, average grain size: 0.07 μm) at a silver coated amount of 0.5 g/m$^2$ and an emulsified dispersion of Ultraviolet Ray Absorbing Agent UV-1.

Twelfth Layer: Second Protective Layer

A gelatin layer containing polymethyl methacrylate particles (diameter of about 1.5 μm).

In each of the above-described layers were further incorporated Gelatin Hardening Agent H-1 and a surface active agent in addition to the above-described compounds.

The compounds used for preparing Samples were as follows:

Coupler EX-1:

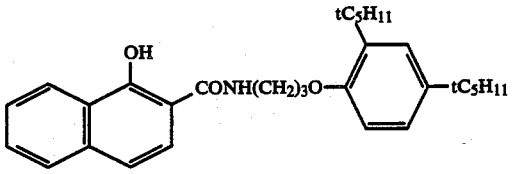

Coupler EX-2:

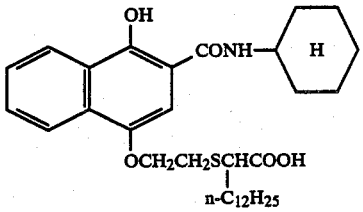

Coupler EX-3:

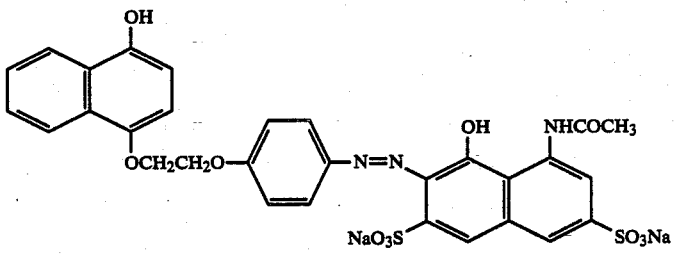

Coupler EX-4:

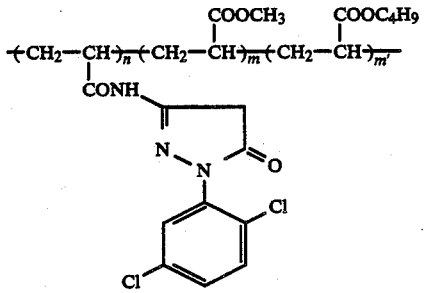

n/m + m' = 1 (by weight) m/m' = 1 (by weight)

molecular weight: about 40,000

Coupler EX-5:

-continued
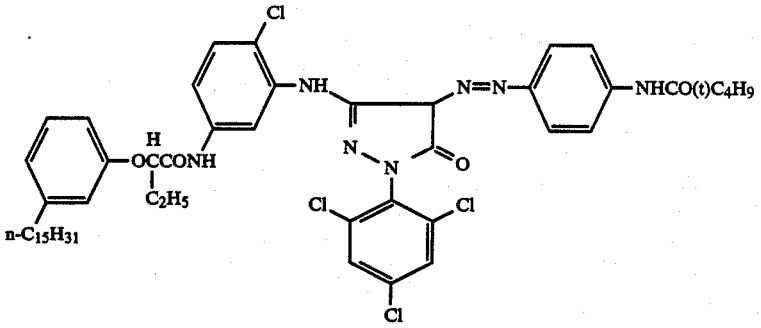
Coupler EX-6:
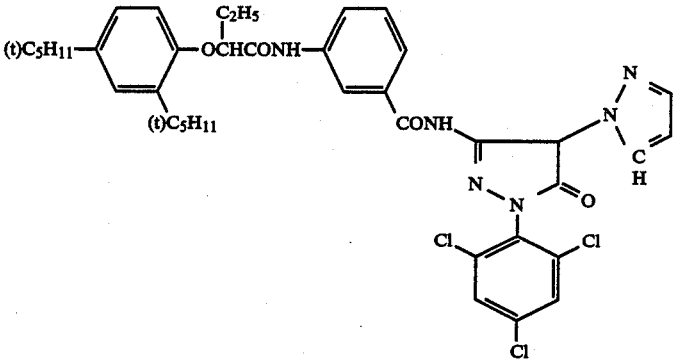
Coupler EX-7:
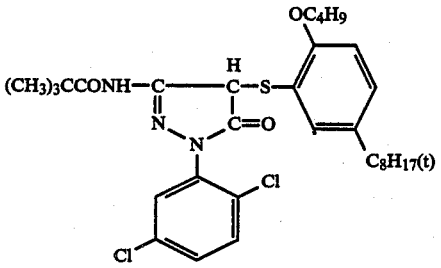
Coupler EX-8:
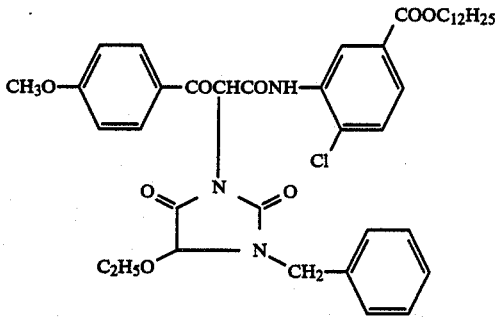
Coupler EX-9:
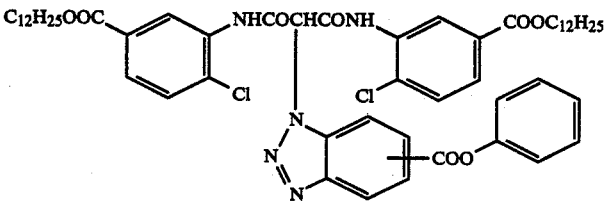
Coupler EX-10:

-continued

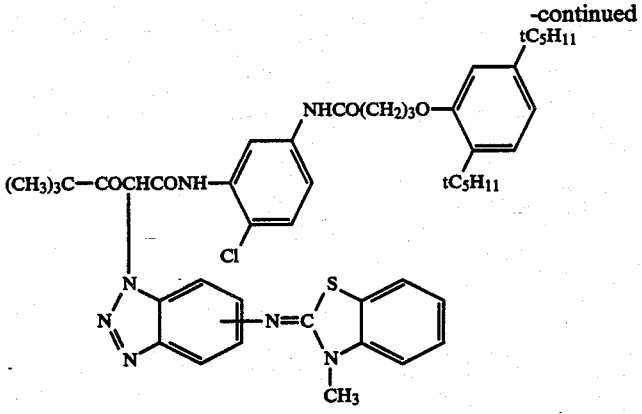

Gelatin Hardening Agent H-1:

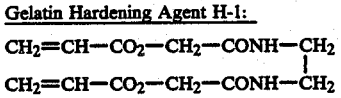

Ultraviolet Ray Absorbing Agent UV-1:

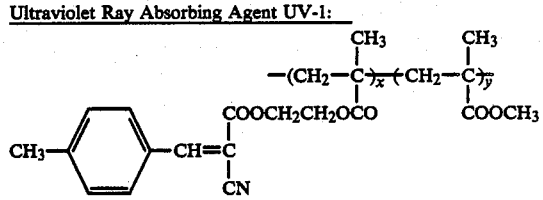

x/y = 7/3 (by weight)

The emulsions employed and the corresponding samples (Samples 301 to 304) are shown in Table 3 below.

These samples were exposed to light in the same manner as described in Example 2 and then subjected to development processing according to the above-described Processing (2) to obtain images. The graininess of the yellow and magenta images and the sharpness of the magenta and cyan images were measured in the same manner as described in Example 2 for each of the samples and the results thus obtained are shown in Table 3.

TABLE 3

| | Emulsion Used in Second Blue-Sensitive Emulsion Layer | | | Emulsion Used in Second Green-Sensitive Emulsion Layer | | | Graininess* | | Sharpness (25 cycles/mm) | |
|---|---|---|---|---|---|---|---|---|---|---|
| Sample No. | Emulsion | Coefficient of Variation (%) | Average** Aspect Ratio | Emulsion | Coefficient of Variation (%) | Average** Aspect Ratio | Yellow Image | Magenta Image | Magenta Image | Cyan Image |
| 301 (Comparison) | G (Spherical) | 15 | — | K (Spherical) | 15 | — | 19.5 | 13.3 | 0.80 | 0.71 |
| 302 (Comparison) | H (Tabular) | 28 | 33 | L (Tabular) | 28 | 33 | 23.8 | 15.0 | 0.95 | 0.85 |
| 303 (Invention) | I (Tabular) | 19 | 33 | M (Tabular) | 19 | 33 | 19.5 | 12.8 | 0.93 | 0.84 |
| 304 (Invention) | J (Tabular) | 18 | 26 | N (Tabular) | 18 | 26 | 19.6 | 12.3 | 0.94 | 0.85 |

*The graininess was measured at density of fog + 0.5.
**As defined in Table 1.

From the results shown in Table 3, it is apparent that the graininess is degraded although the sharpness is greatly improved with Sample 302, in which conventional tabular silver halide grains are used in the second blue-sensitive emulsion layer and the second green-sensitive emulsion layer, in comparison with Sample 301 which used the spherical silver halide grains in these layers.

In contrast, the sharpness is greatly improved without an accompanying degradation of graininess in Samples 303 and 304 wherein Emulsions I, J, M and N which have the coefficient of variation and the average aspect ratio within the range according to the present invention are employed.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer containing monodispersed silver halide grains wherein at least 50% of the total projected area of the monodispersed silver halide grains is provided by tabular silver halide grains which have an aspect ratio of not less than 5 and less than 30 and wherein the monodispersed silver halide grains have a coefficient of variation of 20% or less.

2. A silver halide color photographic material comprising a support having thereon at least one light-sensitive silver halide emulsion layer containing monodispersed silver halide grains wherein at least 50% of the total projected area of the monodispersed silver halide grains is provided by tabular silver halide grains wherein the aspect ratio of the tabular silver halide grains is not less then 5 and less than 8, and wherein the monodispersed silver halide grains have a coefficient of variation of 20% or less.

3. A silver halide color photographic material as claimed in claim 1, wherein the coefficient of variation of the monodispersed silver halide grains is 15% or less.

4. A silver halide color photographic material as claimed in claim 1, wherein the tabular silver halide grains have a diameter in the range of from 0.3 μm to 5.0 μm.

5. A silver halide color photographic material as claimed in claim 1, wherein the tabular silver halide grains have a thickness of 0.4 μm or less.

6. A silver halide color photographic material as claimed in claim 1, wherein the tabular silver halide grains are silver bromide grains or silver iodobromide grains containing 30 mol % or less of silver iodide.

7. A silver halide color photographic material as claimed in claim 1, wherein the tabular silver halide grains are silver iodobromide grains containing 10 mol % or less of silver iodide.

8. A silver halide color photographic material as claimed in claim 1, wherein the tabular silver halide grains are prepared by maintaining pBr at not more than 2 at the initial stage of crystal growth and successively maintaining the crystal growth rate in a range of from 50% to 100% of the critical crystal growth rate.

9. A silver halide color photographic material as claimed in claim 8, wherein the pBr is maintained at a range from 0.5 to 1.5 and the crystal growth rate is maintained at a range of from 60% to 100% of the critical crystal growth rate.

10. A silver halide color photographic material as claimed in claim 1, wherein the color photographic material comprises at least one red-sensitive silver halide emulsion layer, at least one green-sensitive silver halide emulsion layer and at least one blue-sensitive silver halide emulsion layer.

11. A silver halide color photographic material as claimed in claim 1, wherein the light-sensitive silver halide emulsion layer further contains a dye forming coupler.

12. A silver halide color photographic material as claimed in claim 10, wherein the red-sensitive, green-sensitive and blue-sensitive silver halide emulsion layers contain cyan, magenta and yellow dye-forming couplers, respectively.

13. A silver halide color photographic material as claimed in claim 2, wherein the tabular silver halide grains have a diameter in the range of from 0.3 μm to 5.0 μm.

14. A silver halide color photographic material as claimed in claim 2, wherein the tabular silver halide grains are silver bromide grains or silver iodobromide grains containing 30 mol % or less of silver iodide.

15. A silver halide color photographic material as claimed in claim 2, wherein the tabular silver halide grains are silver iodobromide grains containing 10 mol % or less of silver iodide.

16. A silver halide color photographic material as claimed in claim 2, wherein the tabular silver halide grains are prepared by maintaining pBr at not more than 2 at the initial stage of crystal growth and successively maintaining the crystal growth rate in a range of from 50% to 100% of the critical crystal growth rate.

* * * * *